United States Patent [19]

Eickmann

[11] Patent Number: 4,984,970

[45] Date of Patent: Jan. 15, 1991

[54] ARRANGEMENTS ON CONED RINGS WHICH ARE APPLICABLE IN HIGH PRESSURE PUMPS AND RELATED DEVICES

[76] Inventor: Karl Eickmann, 2420 Isshiki, Hayama-machi, Kanagawa-ken, Japan

[21] Appl. No.: 332,319

[22] Filed: Apr. 3, 1989

Related U.S. Application Data

[63] Continuation-in-part of Ser. No. 926,921, Oct. 22, 1986, abandoned.

[51] Int. Cl.[5] ..... F04B 43/02

[52] U.S. Cl. ..... 417/271; 417/383; 417/395; 417/472; 92/90; 92/103 M

[58] Field of Search ..... 417/383, 388, 395, 271, 417/472; 92/90, 103 M, 130 B

[56] References Cited

U.S. PATENT DOCUMENTS

| | | |
|---|---|---|
| 1,764,712 | 6/1930 | Brackett et al. . |
| 3,093,086 | 6/1963 | Altoz et al. . |
| 3,814,548 | 6/1974 | Rupp . |
| 4,443,160 | 4/1984 | Berthold . |
| 4,634,351 | 1/1987 | Leonard et al. . |

FOREIGN PATENT DOCUMENTS

| | | |
|---|---|---|
| 3226067 | 9/1983 | Fed. Rep. of Germany . |
| 3200665 | 2/1984 | Fed. Rep. of Germany . |

*Primary Examiner*—Gerald A. Michalsky

[57] ABSTRACT

When pumping chambers were provided between tapered discs of axial compressibility and expandability, the discs worked perfect in the subcritical pressure range. But in the supercritical pressure range the high pressure in fluid would depart the discs away from each other and open a gap between the discs because the force of pressure in fluid in the chamber between the tapered discs was higher than the internal strength of the material of which the respective coned element was made. The invention now discovers that it is possible to provide a means which prevents the departure of a coned ring from a neighbored ring. The invention obtains this by providing a means which presses under actions of pressure in surrounding fluid the neighboring coned ring elements at all times together for a close and perfect sealing between them. This means which the invention now discloses is the provision of seals radially inwards and outwards of a defined radial dimension of a meeting area between two neighborings discs of a respective pair of coned ring elements. The radial extension of the meeting area defines the force with which the neighboring elements are pressed against each other for a close sealing procedure. The elements are produced from respective material, for example, from hardened stainless steel.

21 Claims, 8 Drawing Sheets

(1) $(B^2-A^2)\pi/4 > (b^2-a^2)\pi/4$ (2) $F\Delta B = (B^2-b^2)\pi/4$ (3) $F\Delta A = (A^2-a^2)\pi/4$ (4) $P_o F\Delta B = P_o(B^2-b^2)\pi/4 => 0$ (5) $P_i F\Delta A = P_i(A^2-a^2)\pi/4 => 0$ (6) $MP_i(515) > MP_o(515)$

Fig. 18

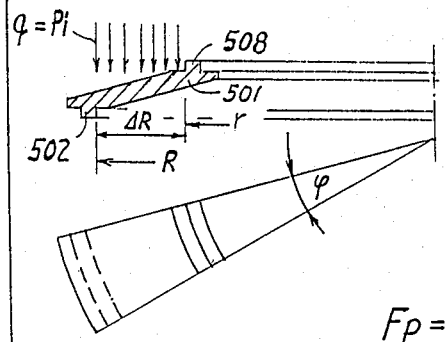

$$dMd = q\,B\,\Delta R\,d(\Delta R)$$

$$B = \frac{\varphi\pi}{180}(r+\Delta R) \text{ or } B = \frac{\varphi\pi}{180}(R-\Delta R)$$

$$\frac{\varphi\pi}{180} \text{ for } 360° = 2\pi$$

$$Md = \int q\frac{\varphi\pi}{180}(r+\Delta R)\,d(\Delta R)$$

$$Md = 2\pi q\left[\frac{r}{2}(\Delta R)^2 + \frac{1}{3}(\Delta R)^3\right]; \text{ or;}$$

$$Md = 2\pi q\left[\frac{R}{2}(\Delta R)^2 - \frac{1}{3}(\Delta R)^3\right]$$

$$Fp = \Delta Md / \overline{\Delta R}$$

Fig. 19

$B = dTF \cdot \pi$
$P_o$ = axial Load
$K = P_o / 2RB$
$W = R \sin\beta$
$q = R - R\cos\beta$
$P_H = \sqrt{K \cdot E / 2.86}$
$P_m = P_H / 1.27$
$P_{max} = 1.5\, p_m$
$\sin\gamma = b/R$
$G = R\cos\gamma$
$h = R - R\cos\gamma$
E = MODULUS OF ELASTICITY
h = depth of compression
b = width of compression
$P_H$ = HERTZ's pressing
$P_m$ = medial stress

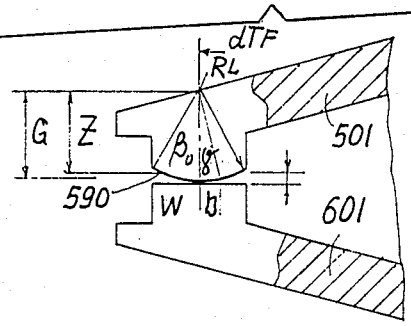

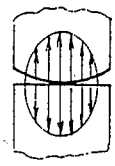

$$b = 1.075\left(\frac{K}{E}\right)^{0.5} 2R$$

ARRANGEMENTS ON CONED RINGS WHICH ARE APPLICABLE IN HIGH PRESSURE PUMPS AND RELATED DEVICES

REFERENCE TO RELATED APPLICATIONS

This is a Continuation in part of my application Ser. No. 06-926,921 which was filed on Oct. 22 of 1986, now abandoned.

BACKGROUND OF THE INVENTION

In my U.S. Pat. Nos. 4,701,113; 4,690,623 and 4,799,654 I have described the coned ring elements which are able to work in the supercritical pressure range of pressures higher than 1000 atmospheres in the pumping chamber between two neighboring pumping elements. Also described in the mentioned publication are the drive means to operate the strokes of the coned ring elements. However, the pressure ranges of the arrangements of the mentioned patents were effective only until about 1500 or some more hundred atmospheres. They could work at higher atmospheres but the efficiency would have made the devices uneconomical at such higher pressure ranges.

Since, however, for water jet cuttings and other purposes still higher pressures, for example, of 4000 atmospheres are often required, there remains a need to develop a new pumping means which would be economical in cost, maintenance, operation and which would be reliable in operation for a long an useful life.

OBJECT OF THE INVENTION

It is therefore the object of the invention to provide a device which is able to supply fluid, including non-lubricating fluid, like water, for pressures of more than 100 atmospheres for economic costs, operation and durable life with reliable operation of several thousand atmospheres.

BRIEF DESCRIPTION OF THE DRAWINGS:

FIG. 18 is a sketch defining geometrical and mathematical values.

FIG. 19 is a sketch defining geometrical and mathematical values.

DESCRIPTION OF THE PREFERRED EMBODIMENTS

Figure 1:
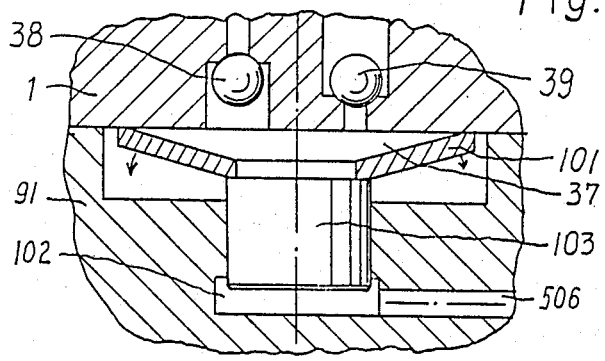
PRIOR ART Fig. 1
FIG. 1 is a longitudinal sectional view through a device of the prior art.

In the longitudinal sectional view through a device of the prior art of FIG. 1 the drive piston is located in a cylinder into which pressure is supplied through passage 506. The high pressure fluid in cylinder 102 presses against the bottom of piston 103 and thereby piston 103 upwards against the bottom of the tapered ring element 101. When the piston meets the bottom of element 101 the chamber inside of the tapered, coned, portion of element 101 is closed. At further upwards movement of piston 103 the fluid in chamber 37 is compressed and delivered through exit valve 39. New fluid enters the inner chamber 37 through the entrance valve 38 when the element 101 expands. This action works perfect in the subcritical pressure range.

To understand the present invention the following means are now defined:

(a) a ring which forms a tapered or coned configuration, like a disc spring, also called "Belleville spring", is in this application called "element", "tapered ring", or "coned ring".

(b) the chamber formed inside of the tapered ring is called: "inner chamber".

(c) The chamber outside of an element is called: "outer chamber".

(d) The lower pressure range at which the force of fluid in the inner chamber is weaker than the stress inside of the element is called "subcritical range" and this range defines that the pressure in fluid can not press the element away from its position and it can not open the inner chamber because the internal stresses in the element keep it in position and keep the inner chamber closed.

(e) The higher pressure range at which the forces of fluid of high pressure in the inner chamber compress the element, press it away from its position and open the inner chamber is called "supercritical pressure range" or "supercritical range".

It was said that the device of FIG. 1 works, as described, perfectly in the subcritical range. As soon, however, as the pressure inside of the inner chamber obtains the higher pressure of the supercritical range the radial outer portions of element 101 depart in the direction of the arrows in FIG. 1 away from the head 1 and open the inner chamber 37 whereby the pumping action stops and no fluid can be delivered any more through the exit valve 39. Because the force of high pressure in the fluid in the inner chamber 37 overweighs the inner stresses in the element 101 and presses its radial outer portions away from the closing of the chamber by the radial outer portions of the element 101.

It is seen therefrom that the device in body 91 and head cover 1 of FIG. 1 of the prior art can work only at low pressures, namely work only in the subcritical pressure range. Where the turning point from subcritical to supercritical pressure exists is a matter of the strength, size and thickness of the element or coned ring 101.

Figure 2:
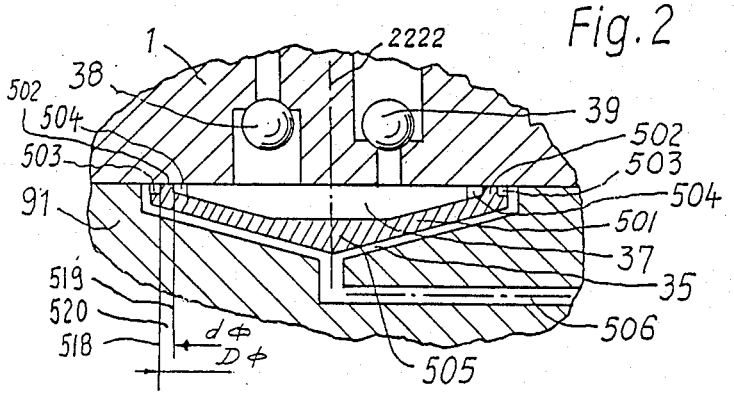
FIG. 2 is a longitudinal sectional view through a device of the invention.

Since the object of the present invention is to overcome this limitation of the prior art of FIG. 1, the FIG. 2 now shows the arrangements of the invention which overcomes the limitations of the prior art by changing the former art device of FIG. 1 into a device of the invention for ability to operate securely and reliably in the supercritical pressure range.

Thus, in FIG. 2 the element 501 around axis 2222 is assembled instead of element 101 of FIG. 1. Element 501 has a bottom 505 which closes the element radially inwards. In the opposite axial direction the element 501 has close to its radial outer end on the radial outer portion an annular axial extension 502, hereafter called a "ring nose" with inner diameter "d" and with outer diameter "D". Radially inwards of the ring nose is a seal bed 504 provided and radially outwards of the ring nose is an outer seal bed 503 provided. Plastic seals may be inserted into the mentioned seal beds.

High pressure is now led through passage 506 into the outer chamber 35 which is formed between housing 91, cover or head 1 and the element 501. This high pressure compresses the element 501 upwards and enforces the delivery of fluid out of inner chamber 37 through the exit or outlet valve 39 at the reduction of the volume of the inner chamber by the compression of the element 501. In case of FIG. 2, the device of the invention, the radial outer portions of the element 501 of the present invention will not depart from cover 1 and not open the inner chamber, regardless how high the pressure in the outer chamber might become because the inner chamber now extends radially only until the inner diameter "d" of the ring nose of element 501 of the invention while the pressure of the outer chambner 35 acts on the bottom of the element 501 until the outer diameter "D" of the ring nose 502 of the present invention. Since according to this novel arrangement of the invention with diameter "D" greater than diameter "d" the area of pressure acting from the outer chamber is greater than the area acting from the inner chamber against the element, the element is at all times and at all pressures forced with its ring nose 502 into closing and sealing contact with the head face of the cover 1. The inner chamber 37 is and remains, thus, according to the present invention, closed and sealed at all pressures and times of compression of the element and thereby at all pressures and times of the delivery stroke of the element.

Figure 3:
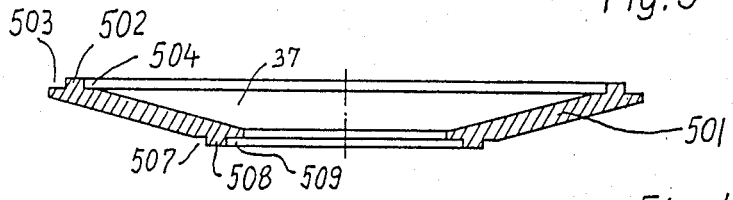
FIG. 3 is a longitudinal sectional view through a device of the invention.

FIG. 3 shows an element 501 of the invention for the self sealing effect of the invention in both axial directions. The ring nose 502 and the seal beds 503 and 504 correspond to those of the element of FIG. 2. On the radial inner portion, close to the inner end of the element 501 is the second ring nose 508 provided on the element and forms an annular axial extension in the axial direction opposed to the axial direction of ring nose 502. On the radial inner and outer ends of ring nose 508 are the seal beds 507 and 509 provided, similar as the beds 503 and 504 on the other axial end of the element and on the other ring nose 502.

Figure 4:
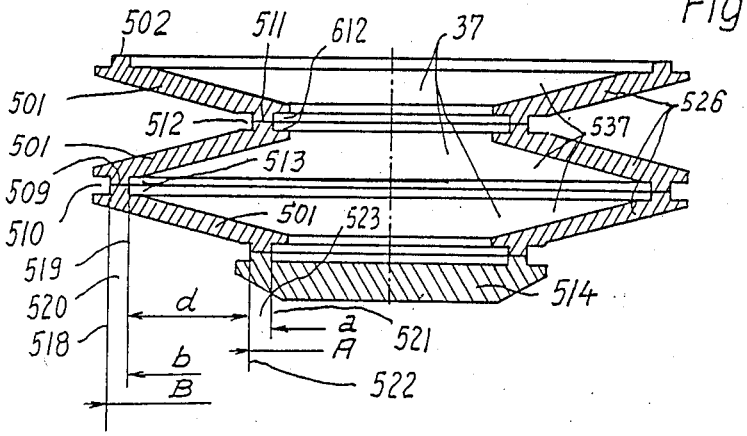
FIG. 4 is a longitudinal sectional view through a device of the invention.

FIG. 4 shows a plurality of elements of FIG. 3 assembled to pairs of elements with one element of the respective pair axially oppositionally directed. Thereby a inner chamber portion 37 is formed between a pair of two neighboring elements 501. The bottom most element 501 of the set of elements 501 of FIG. 4 is closed by a bottom element 514. This bottom element has again a ring nose which is led against the ring nose of the next element. The uppermost element has the ring nose 502 which is to be led against the plane face of a respective cover 1. This upper element meets the next element by faces 511 of the neighboring ring noses and forms thereby the seal beds 512 and 612. The meeting faces 511 are formed by ring noses 508. The second element from top meets the third element from top in the faces 509 by the ring noses 502 whereby the seal beds 510 and 513 are formed. The radial outer noses 502 are extended from diameters "b" to "B" while the radial inner noses are extended from diameters "a" to "A". The radial distance between the outer diameter of the (radially) inner noses to the inner diameter of the outer noses is "d". Referentials 37 and 537 show portions of the inner chamber 37 between respective elements and referentials 526 show respective coned portions of respective elements of the element set assembly of the Figure. The mentioned diameters of respective noses are also defined by the respective referntial numbers 518,519 and 521,522. Between referentials 518,519 is the radial extension 520 of the outer noses defined, while referential 523 defines the radial extension of the inner nose between the diameter referentials 521 and 522.

Figure 5:
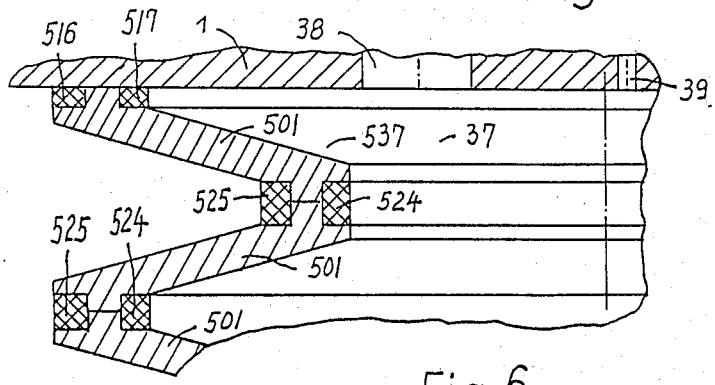
FIG. 5 is a longitudinal sectional view through a device of the invention.

In FIG. 5 a portion of an assembly of a set of elements 501 is shown with the uppermost element laid against the face of the cover 1 and with respective plastic or other seals 516,517,524,525 inserted into the respective seal beds which are now known from FIGS. 2 to 4.

Figure 6:
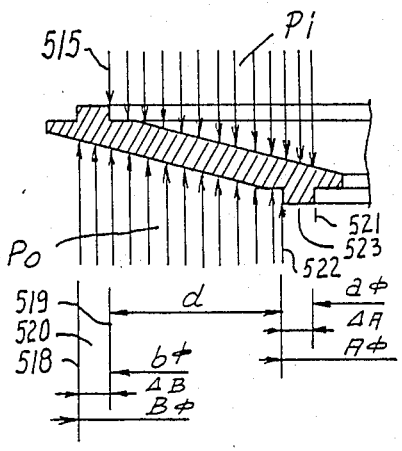
FIG. 6 is a longitudinal sectional view through a device of the invention.

In FIG. 6 the differences of the inner and outer diameters of the noses are defined as "ΔA" and as "ΔB" respectively. The arrows above the element show the action of the pressure "Pi" in the inner chamber against the element and the arrows below the element show the action of the pressure "Po" in the outer chamber against the element. Pressure "Pi" then acts radially inwards of inner diameter 515 of the outer nose while pressure "Po" acts radially outwards of the outer diameter 522 of the inner nose.

Considering now the pressure fields "Po" and "Pi" in FIG. 6, the following results will be found:

$$(B^2-A^2)(\pi/4)>(b^2-a^2)(\pi/4) \quad (1)$$

$$F_{\Delta B}=(B^2-b^2)(\pi/4) \quad (2)$$

$$F_{\Delta A}=(A^2-a^2)(\pi/4) \quad (3)$$

$$Po\cdot F_{\Delta B}=Po(B^2-b^2)(\pi/4)=\geqq 0 \quad (4)$$

$$Pi\cdot F_{\Delta B}=Pi(A^2-a^2)(\pi/4)=\geqq 0 \quad (5)$$

and:

$$M_{Po,522} > M_{Pi,522}; M_{Pi,515} > M_{Po,515} \quad (6)$$

with F=area and M=moment around the respective root 522,515 of the respective field of pressure in fluid.

These equations teach that the meeting noses of adjacent elements will at all times be pressed together (towards each other) by the forces of the fluid in the inner and outer chambers if both pressures are equal. In practical application the pressure in the outer chamber is slightly higher than the pressure in the inner chamber because the force in the outer chamber has to overcome the internal stresses in the elements to compress the elements.

Figure 7:
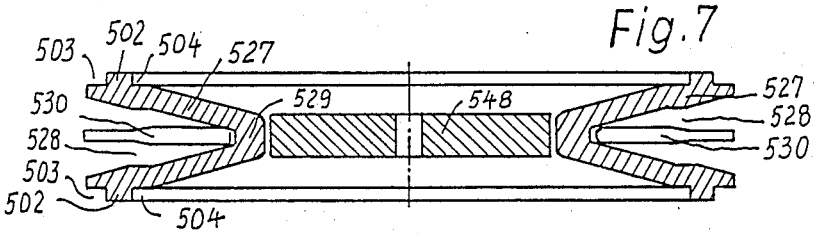
FIG. 7 is a longitudinal sectional view through a device of the invention.

FIG. 7 now illustrates the next step of the present invention, namely to combine two adjacent elements on their radial inner roots to a single body "V-element". Two axially symmetric directed elements 501 are combined on their radial inner portions by the common root 529 to one V-element 527. Thereby the inner noses 508 of FIG. 3 are spared and replaced by the common root 529. The radial outer portions of the tapered ring portions then have the oppositionally directed axially extending noses or ring noses, axially extending ring portions, 502 with the bordering seal ring beds 503 and 504. Between the element portions—or in other words, between the "shanks" of the V-shaped element, is the space 528 appearing. This space would provide a fluid filled dead space wherein the fluid would compress and provide a compression loss which would reduce the efficiency of the device. Consequently, the invention prevents such internal compression losses by the insertion of a dead space filler 530 into the space 528 between the shanks of the V-element. To make the insertion possible the dead space filler 530 is divided into two parts by a radially directed slot. By this reason in FIG. 7 the view is led through the slot between two members of the dead space filler 530 and consequently, there is no hatching, because the section runs through the slot between the both portions of the dead space filler 530. Similarly, a further dead space filler 548 is set radially inside of the element. Since it can be made of a single body, this filler has hatching lines in the Figure and a bore is shown in it to enable flow from one portion of the inner chamber into another portion of the inner chamber radially inwards of a neighboring V-element or element.

Figure 8:
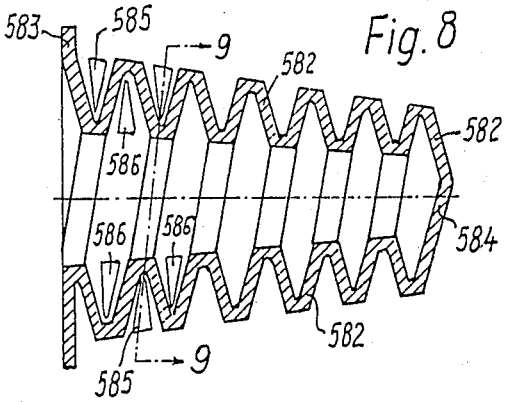
FIG. 8 is a longitudinal sectional view through a device of the invention.

FIG. 8 illustrates in a longitudinal sectional view an "S-element" of the invention. It has a flange 583 to be fastened between the housing 91 and the cover 1. Coned ring element portions extend from the flange in axial direction and they are combined with neighboring coned ring element portions by inner roots and outer roots with the elements shown by 582. In this Figure the diameters of the elements and roots decrease with increase in distance from the flange and the element is closed on its rear end by a bottom portion 584. The feature of this "S-element" is that the inner dead space filler can be screwed into the interior of the element in such a style as a bolt can become screwed into a nut. This inner dead space filler is shown by 586 while the outer dead space filler is shown by 585.

Figure 9:
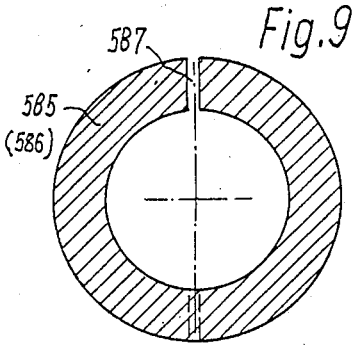
FIG. 9 is a cross sectional view through FIG. 8 along line 9—9 of FIG. 8.

FIG. 9 illustrates that the outer dead space filler 585 (or also the inner filler 586 or the outer filler 530 of FIG. 7) can be devided into portions by the radially extending slot 587.

Figure 10:
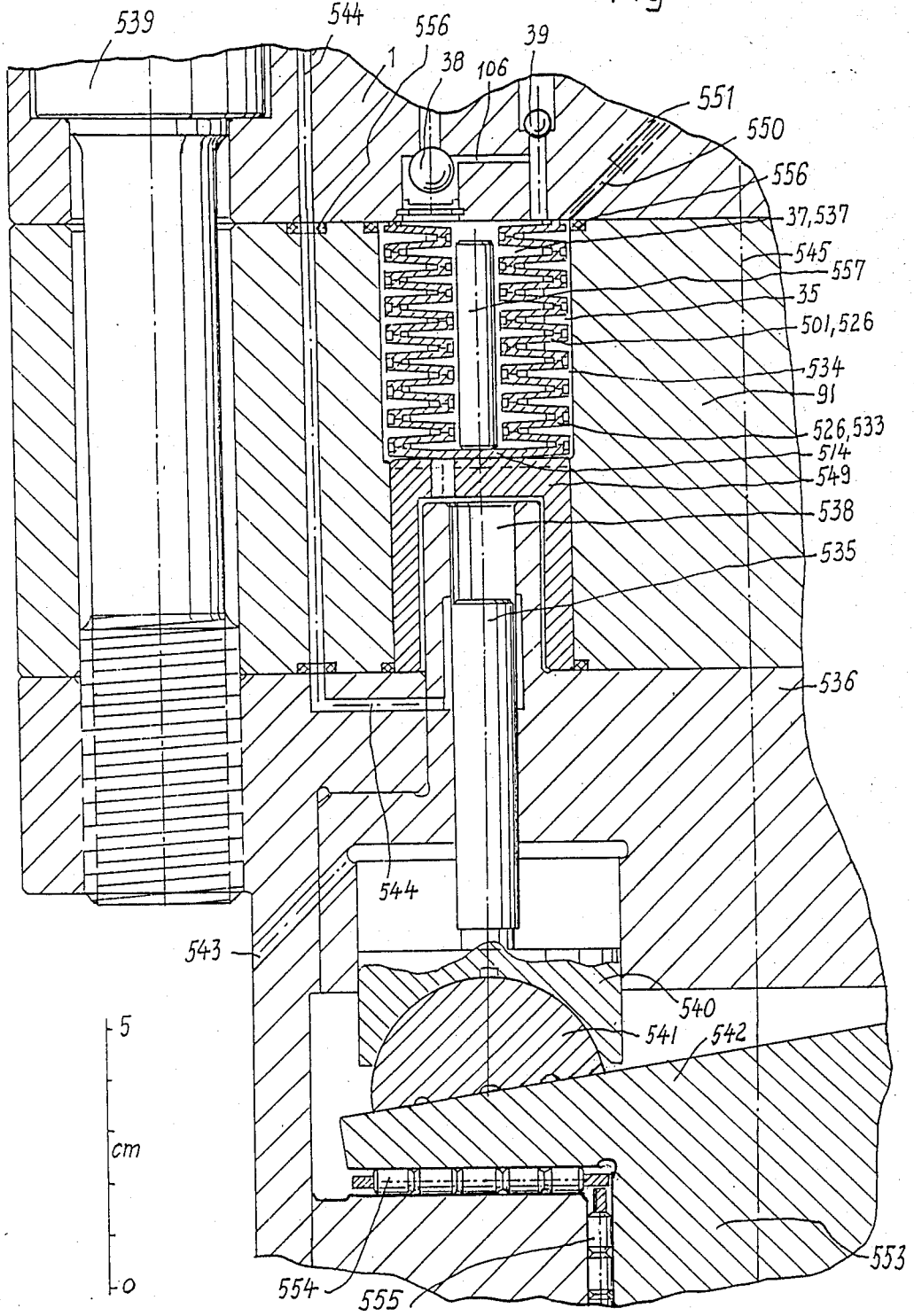
FIG. 10 is a longitudinal sectional view through a device of the invention.

FIG. 10 then illustrates in a longitudinal sectional view a device, for example, a pump, wherein elements of this invention are used. The Figure shows a portion of such pump or device. Head cover 1 is bolted by strong fasteners 539 onto the housing 91. The housing has big walls to prevent radial expansion of the outer chamber 35 under high pressure in fluid. The assembly is arranged around the axis 545 with for example, 5 or 7 assemblies around a respective number of outer chambers 35. Inside of outer chamber 35 is a set of elements 501 assembled and surrounds the inner chamber 37 to seal it against the outer chamber 35. Inlet and outlet valves 38,39 lead to the inner chamber 37. A bottom body 536 has pistons 535 which press fluid from a respective cylinder 538 into the outer chamber 35. The pistons may have a piston head 540 to bear swingably therein a piston shoe 541 which slides on a piston stroke guide face of a piston stroke guide means (inclined revolving face) 542. The piston stroke guide body 542 can be revolved by the shaft 553 and can be borne in radial and axial bearings 554 and 555. A bore 543 lets escape fluid from the space wherein the piston head 540 runs to prevent compression of fluid in this space. A passage 544 is provided to lead fluid from a fluid supply means into the outer chamber 35 to fill it with the required amount of fluid. This fluid may be, for example, oil, while the fluid flowing through the inner chamber can also be a nonlubricating fluid as, for example, water. An overflow passage 550 with a seat 551 for a valve is provided to let air and excessive quantity of fluid flow out of the outer chamber 35 at those times when the piston 535 is in its outermost dead point location and at times close to this location. Passages 544 and 550 are required because without them it is not secured that the outer chamber 35 contains the proper amount of liquid. If the amount of liquid in the outer chamber 35 is not of the correct quantity or if it contains air, the fluid in the outer chamber will not compress the elements and the pump can then not properly work. The stroke of piston 535 would be ineffective. At proper design and building the piston 535 will move downward in a suction stroke to let fluid enter through inlet 38 into the inner chamber 37 at one half of a revolution of shaft 553 and at the following half of the same revolution the piston 535 will move upwards to press fluid from cylinder 538 into the outer chamber 35, thereby compressing the elements 501,526 to reduce the volume of the inner chamber 37 and thereby to press fluid out of inner chamber 37 through outlet 39 out of the inner chamber. Thereafter the cycle repeats and the pump can in this style deliver water of several thousand atmospheres pressure out of chamber 37. Passage 106 serves for the automatic discharge of air from the fluid. Seals 556 are provided to seal the uppermost element on the cover 1. 537 shows the inner chamber 37 in a complete pump. 557 is an inner guide and at the same time a dead space filler to guide the set of elements against radial displacement and to fill the interior of the elements. By 534 the bore in the housing is shown which forms the wall of the outer chamber 35. 537 shows inner dead space fillers between the elements and 533 shows the outer dead space fillers between the shanks of the respective elements. Passage 514 secures a flow way between the piston 535 or the cylinder housing 549 and the bottom cover of the set of elements.

Figure 11:
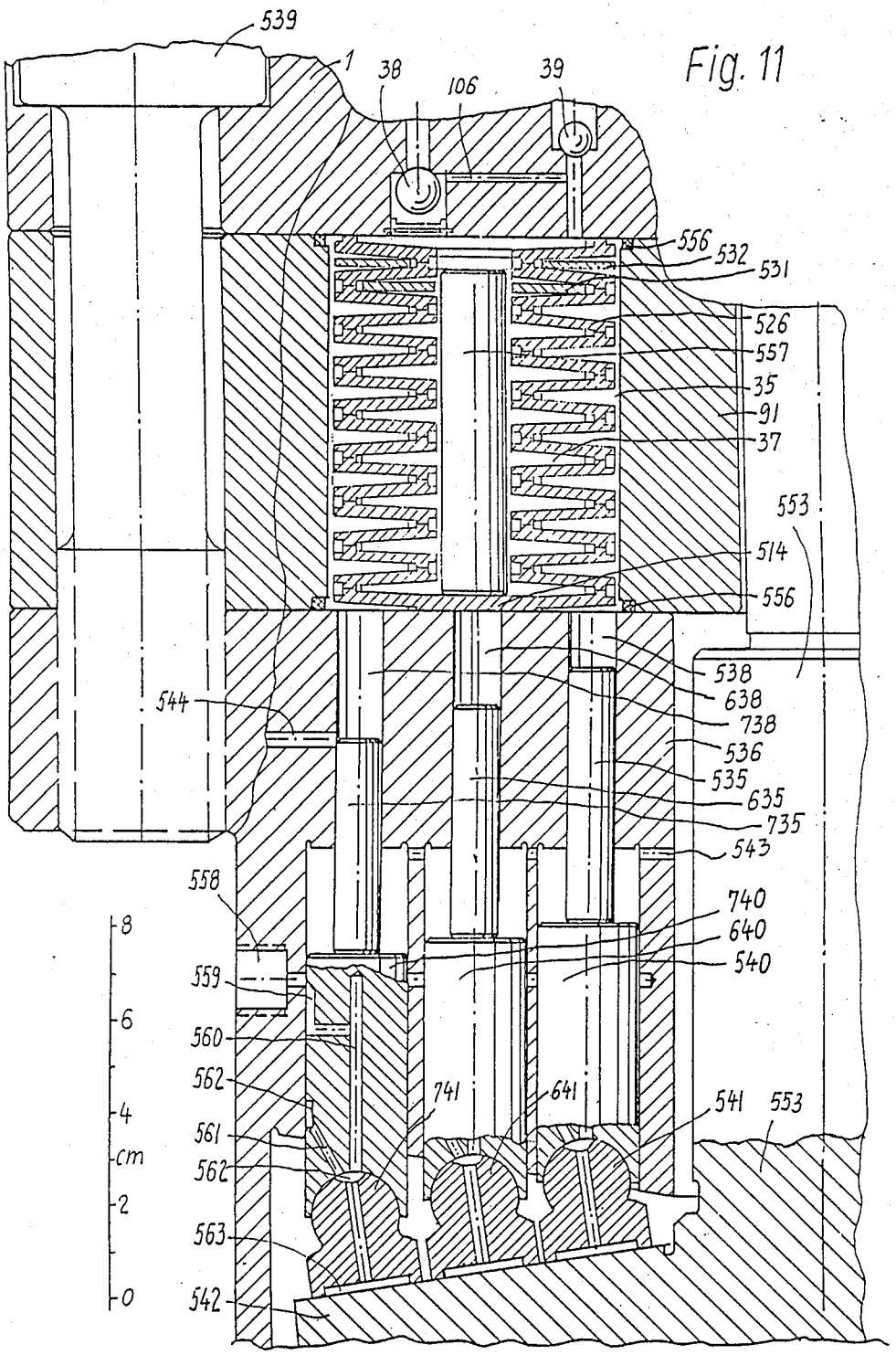
FIG. 11 is a longitudinal sectional view through a device of the invention.

The means which are described for FIG. 10 are also substantially present in FIG. 11 and will not be described for FIG. 11 any more because they have become known from the description of FIG. 11. Scales are provided in FIGS. 10 and 11 to indicate the geometric size relationships for a pump with 50 or 60 mm diameters of the chambers 534.

FIG. 11 shows in addition to the means of FIG. 10 the shaft 553 extending axially through the entire device. Further, the pistons have bigger and smaller diameter ends whereby the piston portions 535,635 and 735 form the fluid delivery pistons to deliver at their pressure strokes fluid from cylinders 538,638,738 into the outer chamber 35. Piston portions 540,640,740 are the guide portions of diameters bigger than the diameters of the other portions of the respective pistons in order to permit the bearing of piston shoes 541,641,741 in the respective bearing beds of the respective pistons. The bigger diameter portions of the pistons are provided to make it possible that the piston shoes can operate at a lower pressure than the pressure of several thousand atmospheres in the cylinders and chambers. A respective lubrication fluid supply passage arrangement 558,559,560 to 563 supplies fluid under respective pressure to the pistons and piston shoes. Passage 543 secures low pressure or no pressure in the guide cylinders for pistons 540,640,740 and lets leakage fluid escape from the mentioned guide cylinders wherein the bigger diameter piston portions 540,640,740 are guided. It should also be noted that in FIG. 11 a plurality of fluid supply pistons 535,635,735 act to a common outer chamber 35. By 514 the bottom cover of the set of elements is shown and it can have a passage towards the respective pistons if so desired in the gist of FIG. 10, wherein 514 may be the passage in the bottom cover of the set of elements.

Figure 12:
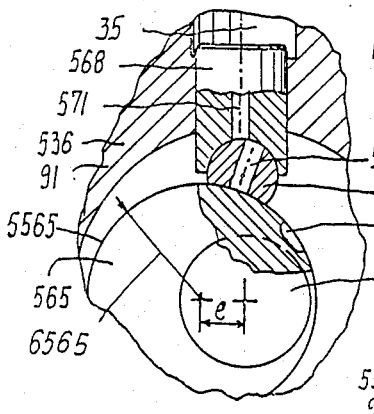
FIG. 12 is a cross sectional view through a device of the invention.

FIG. 12 shows a radial fluid supply piston which can replace the axial stroke pistons of FIGS. 10 or 11. Shaft 564 has the cam 564 with an eccentric guide face whereon the piston shoe 567 is guided while the piston shoe 567 is pivotably borne in the respective bearing bed in the piston 568. When the shaft revolves the eccentric cam face guides the piston to a stroke and return stroke in the cylinder 35 which is communicated to the outer chamber 35 and forms thereby a portion of it. Fluid passages 570 and 571 extend through the piston and the piston shoe towards the stroke guide face of the cam 565. The cam 565 has a recess 566 which meets the passage 570 at a time when the piston is close to its outer dead point. At this time the pressure in chambers 35 and 37 is a minimum and the outer chamber 35 will be filled over the recess 566 and passages 570,571 from the surrounding space around the cam 565 or excessive fluid will flow out of outer chamber 35 at the time when the recess 566 meets the passage 570. The recess 566 is thereby an important control recess for securing a proper operation of the fluid in the outer chamber. It must be correctly located and sized. Housing 536 contains the cylinders 35 whereof only one is shown in the Figure. The guide face 5565 is formed by radius 6565 around an axis which is distanced by the eccentricity "e" from the axis of shaft 564.

Figure 13:
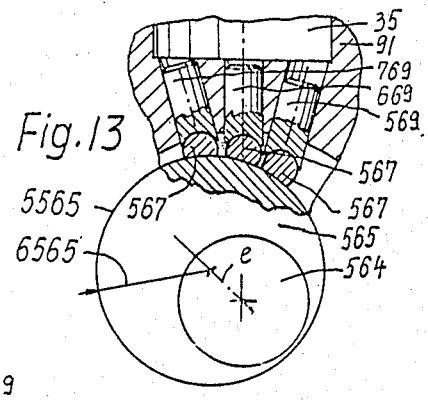
FIG. 13 is a cross sectional view through a device of the invention.

In FIG. 13 a similar arrangement is shown and the means in FIG. 13 which are equal to the means in FIG. 12 will not be further discussed. The speciality of FIG. 13 is that a plurality of pistons 569,669 and 769 with piston shoes 567 are arranged to work together with a single outer chamber 35, meaning to supply one after the other and timewise all three together fluid into their common outer chamber 35. The feature thereof is that the flow obtains a better uniformity for a more smooth operation and the other feature is that the load on each piston is smaller than if a single bigger diameter piston would be used.

Figure 14:
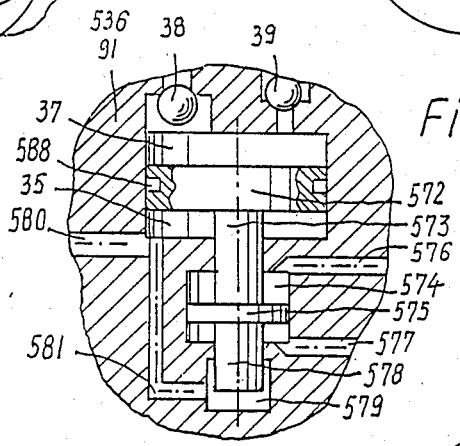
FIG. 14 is a longitudinal sectional view through a device of the invention.

In FIG. 14 a differential piston is used to operate the intake and outflow of the inner chamber 37. The means which are already known from others of the Figures will not be discussed any more. Piston portion 572 reciprocates in the bore in the housing and separates the inner chamber 37 from the outer chamber 35 by a close fit in the bore and/or by the seal 588. Piston shaft 573 extends tighly sealed through the bottom of the bore and into a drive cylinder 574 wherein it has a second piston portion 575 for tight seal at reciprocation in the cylinder 574. Passages 576 and 577 port into the upper and bottom ends of cylinder 574 respectively. By loading them alternatingly from respective fluid flow supply arrangements (not shown in the Figure because they are known in the prior art) the piston 575 is reciprocated in cylinder 574 whereby the first piston portion 572 is reciprocated in the bore in housing 91 for alternating increase and decrease of the volumes of the outer chamber 35 and of the inner chamber 37. The rear end of the piston arrangement is formed by a second piston shaft 578 which is sealingly extended through the bottom of cylinder 574 to move into a fluid supply space 579. Space 579 is provided with a passage 581 which communicates with a passage 580. Passage 580 is communicated to a fluid flow supply means and may be communicated also to the outer chamber 35. Thereby it is managed that the entire cross sectional area of the first piston portion 572 is utilized to press the piston arrangement towards the inner chamber 37 at times of flow delivery strokes of the device or pump. A control means must be set to timely control the flows to and through passages 576,577 and 580.

Figure 15:
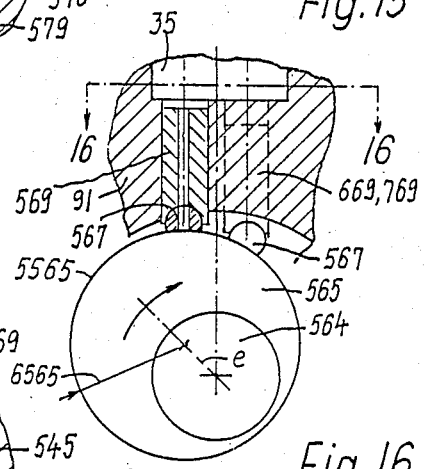
FIG. 15 is a cross sectional view through a device of the invention.
Figure 16:
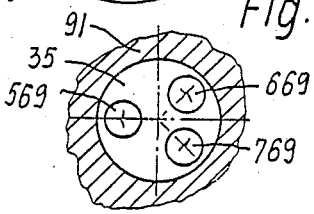
FIG. 16 is a cross sectional view through FIG. 15 along line 16—16 of FIG. 15.

FIG. 15 corresponds in principle to FIG. 13. However, FIG. 15 shows the speciality that the multiple pistons per common outer chamber 35 are set into different axially distanced radial planes relative to the axis of the shaft. This will be best understood if FIG. 15 is seen together with FIG. 16 which is a cross sectional view through FIG. 15. In the cross sectional view it is seen that the three pistons are relative to the axis of the outer chamber are arranged under angles spaced around the axis of the chamber. Consequently only piston 569 is seen in FIG. 15 while the piston(s) 669,769 is (are) shown in FIG. 15 in dotted lines. The feature of this arrangement is that when the shaft revolves in the direction of the arrow in FIG. 15, piston 669 starts as first of the three pistons to pump into the outer chamber 35, thereafter piston 569 starts its delivery stroke and finally piston 769 starts its delivery stroke as the last of the three pistons of the common outer chamber 35. This gives a good uniformity of flow and prevents excessive fluctuations of the delivery flow of the device or pump.

Figure 17:
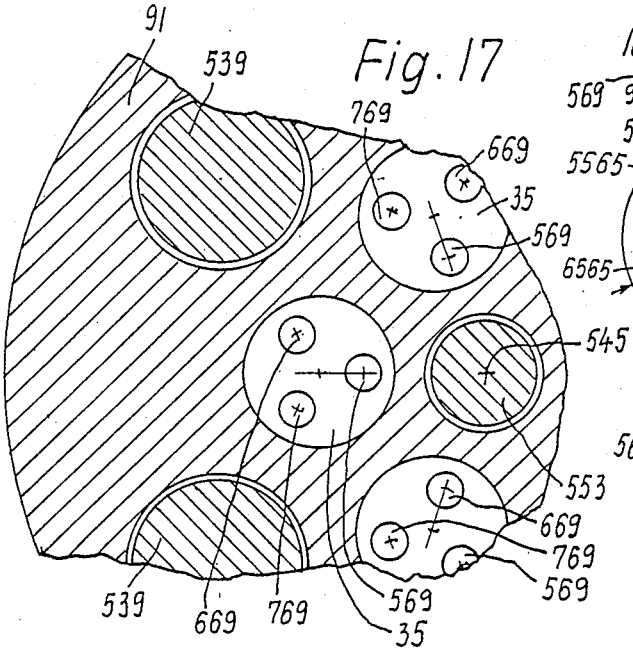
FIG. 17 is a cross sectional view through a device of the invention.

FIG. 17 illustrates a similar arrangement for an axial piston device, such as of, for example, FIG. 11. FIG. 17 may thereby be seen as a cross sectional view through the bores of FIG. 11, however, with the pistons differently located respective to FIG. 11. Seen here are three bores or outer chambers 35 arranged angularly around the axis 545 of the shaft. Seen here are also the big cross sectional areas of the bolts 539 and the big wall of the housing 91 for super high pressure purposes to prevent elongations under high pressures in the outer chambers 35. Relative to each common outer chamber 35 three pistons are provided again similar as in FIG. 16 angularly spaced around the axis of the respective outer chamber 35. If now, seen in FIG. 17, the piston stroke actuator 542 of FIGS. 10 or 11 would revolve clockwise, the piston 669 of the respective outer chamber would start its delivery stroke first, the piston 569 would start its delivery stroke as the second piston and finally the piston 769 would as the third piston start its delivery stroke as the last of the three pistons to deliver fluid into the respective common outer chamber 35 to secure a uniform flow of fluid into the respective outer chamber and out of the inner chambers and outlet valves of the pump or device.

FIG. 18 is supplied to make the calculation of the force with which the adjacent elements are pressed together rather easy and simple. The Figure shows the pressure forces "Pi" of the inner chamber 37 over a portion of an element 501 with ring-noses 502 and 508. The pressure is "q" and commonly calculated in kilogram per square millimeter. The radial difference between the radial ends of the noses is "ΔR" between the radii "r" and "R". Considering a sector of the ring element with angle "ϕ" the moment around the inner root with diameter "r" will be:

$$dMd = qB\Delta R\, d(\Delta R) \tag{7}$$

wherein "B" is:

$$\text{either } B = \frac{\phi\pi}{180}(r + \Delta R); \tag{8}$$

or:

$$B = \frac{\phi\pi}{180}(R - \Delta R) \tag{9}$$

which becomes for 360 degrees, corresponding to the full ring of the element to:

$$B = \frac{360\pi}{180}\text{; or: } B = 2\pi \tag{10}$$

The moments will then become:

$$Md = \int dMd_2 = \int 2q\,\pi(r+\Delta R)d(\Delta R) \tag{11}$$

or, the moment around the outer noses:

$$\int dMd_o = \int 2q\pi(R-\Delta R)d\Delta R) \tag{12}$$

which gives after integration:

$$Md_i = 2q\pi\left[\frac{r}{2}(\Delta R)^2 + \tfrac{1}{3}(\Delta R)^3\right] \tag{13}$$

or:

$$Md_o = 2q\pi\left[\frac{R}{2}(\Delta R)^2 - \tfrac{1}{3}(\Delta R)^3\right] \tag{14}$$

with the resulting force in the meeting circle:

$$F_n = Md/\Delta R \tag{15}$$

Applying this calculation to FIG. 6 one obtains for the pressure field of the outer chamber 35: R=B/2; r=A/2; ΔR=(B−A)/2, and, similarly for that of the inner chamber 37: R=b/2; r=a/2; and ΔR=(b−a)/2. The force which presses the outer noses together would then be:

$$F_{no} = \frac{2\pi q_o\left[\frac{A}{2}(B-A)^2 + \frac{1}{3}(B-A)^3\right]}{(B-A)} - \frac{2\pi q_i\left[\frac{a}{2}(b-a)^2 + \frac{1}{3}(b-a)^3\right]}{(b-a)} \tag{16}$$

and the force which presses the inner noses together would be:

$$F_{ni} = \frac{2\pi q_i\left[\frac{b}{2}(b-a)^2 - \frac{1}{3}\left(\frac{b-A}{2}\right)^3\right]}{(b-a)} - \frac{2\pi q_o\left[\frac{b}{2}(b-A)^2 - \frac{1}{3}(b-A)^3\right]}{(b-A)} \tag{17}$$

If, however, only the forces of fluid above or below the noses would be considered without considering the moments, the force with which the outer noses would be pressed together would be:

$$F_{no} = q_o(B^2 - b^2)\pi \tag{18}$$

and the force with which the inner noses press together would be:

$$F_{ni} = q_i(A^2 - a^2)\pi \tag{19}$$

with a,b,A,B radii, not diameters, in equations (16) to (19).

In the Figures the elements are shown in uncompressed condition. Thereby the noses have radially plane faces. If the elements are, however, compressed, the end faces of the ring noses incline parallel to the changing angle of inclination of the shanks of the elements. That might result in an opening radially outwardly between the outer noses and radially inwardly by the inner noses. These openings between the noses then form annular slots of sharp triangular cross sectional area. This may result in entering of seal portions into these slots. Consequently, the strong, preferredly metalic support rings 699 or 799 are inserted between the noses and the plastic seal rings 596 or 599 of FIGS. 20 to 22. Still better is often to prevent any appearances of such radially opening slots between the noses. How this can be done, by way of example, is illustrated in FIG. 19.

FIG. 19 shows in a longitudinal sectional view portions of a pair of neighboring elements of the invention which are cited by referentials 501 and 601 with element 601 having a radial plane face of the nose while elements 501 has a face of the nose with a radius "R" around ring line "Rl" and the so arched nose face is shown by 590. On the inner and outer ends of the noses the distances "q" will then appear. The arrangement of this Figure of the invention has the feature that the arch with radius "R" around the circle "Rl" with diameter "dTf" is that at compression of the element the arched face 590 will compress to an almost radially plane face and may partially bow into the then partially complementary arching former radial plane face of the nose of element 601. When the compression of the elements is completed the annular gap of size "q" will the disappear and no plastic seal portions can enter any more into any slot because there remains no slot. To obtains this, the equations of FIG. 19 should be obeyed. The hight of plastic deformation, namely "h"=depth of compression, should then be 0.5 of the former gap "q". Depth "h" is:

$$h=R-R\cos\delta \tag{20}$$

but can be found only by calculating all values of FIG. 19. To the value "h" corresponds a respective value of the breadth of the nose, namely the value of 2 times of "b". Thus, when the value "b" which belongs to value "h" is found, "b" is to be multiplied with 2 in order to obtain the ideal radial size "delta R" of the respective nose at which the faces will plsticly deform at the compression of the element without leaving any open gap between the meeting faces of the neighboring noses. Actual calculations show that the noses in these cases have a rather small radial length of "delta R". In the bottom portion of FIG. 19 the stresses which appear in the noses when the faces deform, are indicated. They form an elliptoidal shape with the maximum stresses "Pmax" in the middle. The equation for "Pm" gives the medial internal stresses.

Figure 20:
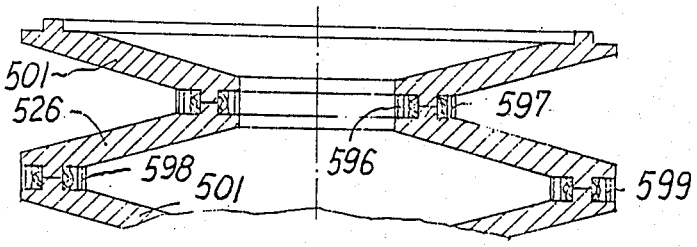
FIG. 20 is a longitudinal sectional view through a device of the invention.

FIG. 20 shows the longitudinal sectional view through an assembly of a plurality of elements of the invention with plastic seals inserted into the seal beds radial inside and outside of the outer and inner noses of the elements. Elements 501 and thereto oppositionally directed elements 526 are shown laid together with their respective cylinder shaped noses. The seals 596 are set radially inside of the inner noses, the seals 597 are set radially outwards of the inner noses, the seals 598 are mounted radialy inside of the outer noses and the seals 599 are assembled radially outwards of the outer noses.

Figure 21:
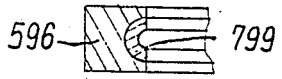
FIG. 21 is a longitudinal sectional view through a device of the invention.
Figure 22:
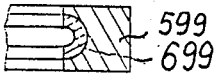
FIG. 22 is a longitudinal sectional view through a device of the invention.

FIGS. 21 and 22 show longitudinal sectional views through portions of the preferred seals. In these Figures each seal has a strong or metalling ring portion 699,799 which meets the respective radial face of the respective noses and which may have a medial recess radially of the meeting faces of the noses. On the other radial end of the strong or metallic seal ring are the plasticly deformable seal portions 596,599 provided which fit with their axial ends on the respective substantially radial plane faces of the elements which form the seal beds. The plastic portions 596 and 599 of the seals follow the deformations of the respective faces of the seal beds when the elements compress or expand and thereby the respective seals seal the meetings of the noses of neighboring elements of the invention.

Figure 23:
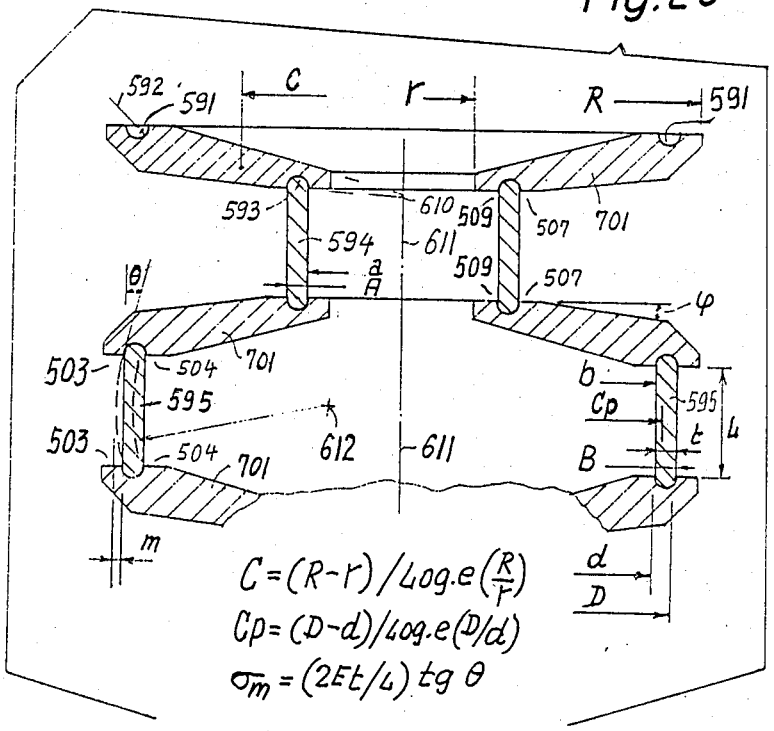
FIG. 23 is a longitudinal sectional view through a device of the invention.

In FIG. 23 a set of elements is illustrated again in a longitudinal sectional view. This assembly consists of elements of the invention and cylindrical pipe portions of the invention between neighboring elements. The elements of this embodiment of the invention have no noses but circular recesses 591 with a respective radius around the axis of the assembly. The recesses 591 are formed with a radius 592 around a respective circular line around the axis of the assembly. There are outer recesses on the radial outer portions and inner recesses, oppositionally directed, on the inner portions of the elements 701. Between neighboring elements 701 are either the outer distance pipes 595 or the inner distance pipes 594 provided. The pipes have a length "L" between the center ring lines of their axial ends and these circular lines form the roots of radii which are equal in length to the radii 592 whereby the ends of the pipe portions are formed with a configuration complementary to the configuration of the recesses 591. The respective ends of the distance pipe portions 594 or 595 thereby fit into a respective arched ring recess 591 of a respective element 701.

The main feature of this embodiment of the invention is that the thickness of the pipe portion "t" defines the radial size of the separation of the inner chamber from the outer chamber and thereby the force with which the elements and pipe portions are pressed together at respective pressures in the chambers 35 and 37. The arched configuration by the radii 592 prevent any opening of gaps or slots between the neighboring elements and pipes, whereby any entering and disturbances of plastic seal portions are prevented. The arrangement is therefore very reliable in operation over a long and useful life. A lubricant is commonly applied between the pipes and elements to permit a swing of the elements on the ends of the pipes. If, however, the lubricant will be used up and the pipes weld or stick in the elements, that must not cause problems because the pipes have a respective thin wall of thickness "t". This wall is so thin that the "L" long pipe can bend to the form of an arch of the dotted lines in the Figure. The respective pipe may bend radially by a size "m" and its ends may get an inclination of angle "$\theta$" corresponding substantially to the angle "$\phi$" of deflection of the respective element at its compression and expansion.

The elements 701 are of such cross sectional configuration that they have even stresses throughout their radial extensions at compression and expansion. That is obtained thereby that the axial end walls of the elements 701 extend in a direction whereof the elongation would meet in a point 610 in the axis 611 of the set of elements and pipes.

The mentioned bending of the pipe 595 occurs not around a point in the axis 611 but around a point 612. With the thickness of the pipe being "t" and the radial deformation being "m" the stress in the pipe 595 would become "$\sigma_m$" and would for a flat bar of thickness "t" and length "L" be calculated by:

$$\sigma_m=(2E\ t/L)\mathrm{tg}\theta \tag{21}$$

(with tg=tangent).

For the actual configuration of the pipe 595 or 594 the configuration as a pipe would have to be considered but there are presently no analytic solutions available.

At the compression and expansion of the elements they swing around the ringline which gives in the sectional drawing of FIG. 23 the point "C". When the distance of this point from the axis 611 is known the radial deflections of the radial inner and outer ends of the elements as well as points therebetween can be calculated. It is therefore important to know the location of point "C". It can be calculated by the equation $$C=(R-r)/\log.e(R/r). \tag{22}$$

Equally important is to know the location "Cp" which would be the neutral face of stresses if the pipe would be a flat plate as assumed above. The distance "Cp" from point 612 would then be:

$$Cp=(D-d)/\log.e(D/d). \tag{23}$$

Good knowledge about the internal stresses inside of elements, rings etc. are essential for obtaining a long life of the respective elements, rings etc. For this purpose the equations of this application are of certain help. Some of them are accurate, others are temporary solutions for rough estimates because accurate analytic solutions are not known at the present time. The technological considerations in this respect are extensive and are given in a number of Rotary Engine Kenkyusho RER reports of the years 1981 to 1985 with some newer reports of 1986 in RER-8609 to RER-8617.

Figure 24:
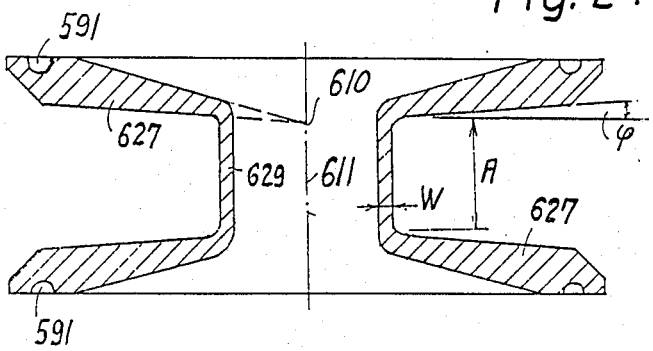
FIG. 24 is a longitudinal sectional view through a device of the invention.

FIG. 24 is a longitudinal sectional view through a "V-element" of the invention as in FIG. 7 but it uses some of the features of portions of FIG. 23. Thus, instead of using the noses of the earlier described Figures it uses the recesses 591 on the radial outer portions of the coned ring portions similar as in FIG. 23. On the radial inner ends of the coned ring portions 627 the root of the "V-element" is formed by a cylindrical portion 629 with thickness "w" and axial length "A". The inwardly directed imagined extensions of the axial end faces of the coned ring portions meet again in point(s) 610 in the axis 611 in order to obtain even stresses throughout the radial extensions of the coned ring portions 627. The angle of deflection at compression and expansion of the "V-element" is "$\phi$". It is seen here that the wall thickness "w" of the root is rather thin in order to prevent big internal stresses and the inner ends of the coned ring portions have substantially equally thin sizes which increase with increas of the respective radii. Pipes 595 may be inserted into the respective recesses 591 to extend into a respective recess 591, in a neighboring element, into a neighboring bottom or into a neighboring head cover 1.

Figure 25:
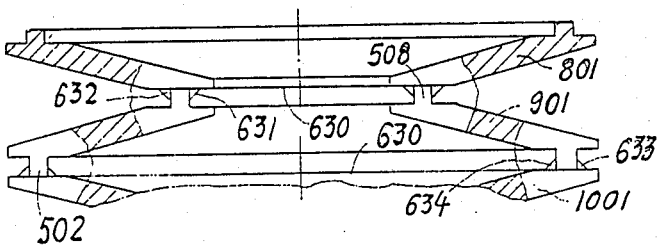
FIG. 25 is a longitudinal sectional view through a device of the invention.

FIG. 25 illustrates that the nose of an element of the invention may also be laid onto a plane face of an adjacent body, for example, of a neighboring element. Here element 801 has a plane face 630 whereagainst a nose 508 of element 901 is laid and the other nose 502 of element 901 is laid against the plane face 630 of element 1001. Corner support rings 631 to 634 may then be set into the corners between adjacent noses and plane faces to support plastic seal rings in the seal ring beds.

Figure 26:
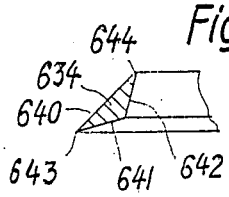
FIG. 26 is a longitudinal sectional view through a device of the invention.
Figure 27:
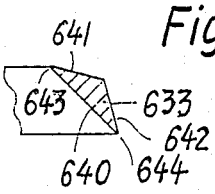
FIG. 27 is a longitudinal sectional view through a device of the invention.

FIGS. 26 and 27 show portions of such corner support rings in sectional view in an enlarged scale. They are provided with a sealmost face 640 to meet the plastic seal ring. But it is preferred to provide inclined faces 641 and 642 in order to seal by ring lines 644 on the respective nose and by ring lines 643 on a respective plane face. The inclined faces 641 and 642 serve to prevent a meeting of the noses or plane faces with these faces because at deflections of the elements circular or plane faces would press the corners 643,644 away from their neighboring faces and open respective gaps.

The corner support rings 641,642 which may also be set at other locations, are very effective and secure good sealing effects. However, axially long noses bring high internal stresses in them at deflections of the elements and respective compromises have to be made in the designs.

The main embodiments of the invention are, defined in short sentences:

(a) In an arrangment which includes a coned ring, the novel provision of a radial distance between ends of seal portions to secure that the ring portion remains pressed against an adjacent portion when equal pressures appear on both axial ends of the coned portion.

(b) The provision of a nose on a radial inner or outer portion of a coned ring with the nose forming substantially cylindrical and axially extending portion of the ring portion.

(c) A pair of coned ring portions combined by a radial inner root to form a "V-element" with two shanks extending radially outwardly from the common root.

(d) The provision of circular recesses in axial ends of radial inner or outer portions of a coned ring portin with the circular recesses bordered by a recess face of a contstant radius around the medial circular line substantially in the direction of the respectiaxial end face of the respective coned ring portion.

(e) The provision of cylindrical pipe portions with ends of a configuration complementary to the configuration of the circular recess in a respective ring portion and the insertion of the respective end of the respective pipe portion into the respective circular recess of the respective ring portion.

(f) The provision of seal beds radially inward and outward of respective noses of a respective portion, and, or seals therefore.

(g) The provision of a pump with a plurality of chambers whereinto seal means are set to separate two different fluids from each other, wherein a piston drive arrangement is provided to drive a piston in a cylinder to press periodically fluid into an outer chamber in said chamber and thereby the seal means towards the inner chamber of the chamber to periodically let in fluid through an inlet means into the inner chamber at times when the piston acts in return strokes and periodically to press fluid through an outlet means out of the inner chamber at times when the piston moves in a delivery stroke.

What is claimed, is:

1. An arrangement of a coned disc for a valved pumping chamber to form radially inside of the coned portion of said coned disc inner chamber which is filled with a fluid while a fluid pressure supply means in provided to supply fluid under pressure into an outer chamber which surrounds at least a portion of said coned disc to compress periodically said coned disc is axial direction to periodically increase and decrease the volume of said inner chamber inside of said coned disc, and an improvement, wherein the improvement exists in the provision of supply and control means for the periodic increase and decrease of the pressure and volume in said outer chamber, and wherein said improvement further includes the provision of a radially defined sealing area between inner- and outer- diameters of said sealing area with said sealing area provided on the radial outer or inner portion of said coned disc with the radial distance between said diameters shorter than one half of the radial length of the coned portion of said coned disc, to secure that said coned disc remains with said sealing area pressed against an adjacent and complementary face, even if equal pressures are provided in both of said chambers and thereby on both axial ends of said coned portion of said coned disc because the pressurized areas of said coned portion of said coned disc differ by said sealing area.

2. The arrangement of claim 1, wherein said coned disc is provided with an inner concentric bore to form a coned ring which is called: "a coned ring element".

3. The arrangement of claim 2, wherein ringshaped noses are provided on at least one radial end portion of a coned ring element to extend axially from the coned ring element with inner and outer diameters and the respective nose meets a respective face of a neighboring body for sealing the inner chamber inwards of the nose from the outer chamber outwards of the nose.

4. The arrangement of claim 3, wherein sealing beds are provided radially inside and outside of said noses and plastic seals and inserted into said seal beds.

5. The arrangement of claim 4, wherein support rings, for example, metalic support rings, are provided between said noses and said seal rings.

6. The device of claim 5, wherein said support rings are provided with annular recesses which are laid radially over and under the meeting faces of the noses of neighboring elements while axial outer portions axially outwards of said recesses are fitted on respective cylindrical faces of said noses.

7. The arrangement of claim 6, wherein said support rings have an inclined face of substantially 45 degrees and said inclined face faces a plastic seal ring while face-close lesser inclined faces are provided to meet said inclined faces in corners which meet respective faces of said elements whereby small spaces of triangular cross sectional shapes are formed between faces of said elements and said less inclined faces and said corners.

8. The arrangement of claim 7, wherein said support rings are set into corners between a nose of one of said elements and a radially plane face of a neighboring body.

9. The arrangement of claim 5, wherein said support rings cover annular small recesses which periodically open and close when said elements compress and expand during operation of a device in which they are applied.

10. The arrangement of claim 3, wherein said noses form head faces and said head faces are configured and dimensioned to compress partially within the plasticity deformable range of the material in order to prevent opening of recesses at compression and expansion of said element.

11. The arrangement of claim 2, wherein two neighboring coned ring elements are combined by a common root on their radial inner portions to form a "V-element" with shanks extending oppositionally axially inclined radially from the root.

12. The arrangement of claim 11, wherein said common root extends substantially axially with the configuration of substantially a cylindrical pipe which has a relative to said shanks thin wall and an axial lentgh which exceeds the thickness of said root.

13. The arrangement of claim 11, wherein said shanks are on their radial outer portions provided with annular grooves which are open in the respective outwards axial direction and which form bearing faces of constant radii around medial circular lines.

14. The arrangement of claim 13, wherein distance members are inserted with one of their axial ends into one of said grooves with the axial ends of said distance members formed with radiii equal to said radii of said grooves but with complementary configuration relative to said grooves whereby said ends obtain an ability to swing in said grooves when said elements compress and expand.

15. The arrangement of claim 14, wherein said grooves and said distance members form said sealing area, seal rings are inserted into the corners between said elements and said distance members to seal said sealing area towards the repective adjacent chamber.

16. The arrangement of claim 15, wherein said distance members are substantially cylindrical pipes with thin walls whereby they have an ability to bow in analogy to the defelection of said shanks at compression and expansion of said shanks.

17. The arrangement of claim 2, wherein a coned ring element is provided on its at least one radial end portion with a circular groove of a cross sectional area which is defined by a radius around the medial circular line of the groove and wherein a cylindrical pipe portion which is provided on a respective axial end with a configuration complementary to the sectional area of the mentioned groove and the mentioned end of the mentioned pipe portion is inserted into the mentioned groove.

18. The arrangement of claim 2, wherein said elements are on their outer and inner portions provided with annular grooves in axially opposed directions, said grooves form bearing beds by constant radii around medial circular lines and wherein complementary relative to said grooves and bearing beds formed ends of distance pipe are inserted into said grooves with one end of one distance pipe into one of said grooves.

19. The arrangement of claim 2, wherein said element is provided in a pump to separate an inner chamber with inlet and outlet valves from an outer chamber which is communicated to a cylinder with a therein reciprocating piston, while said piston at its delivery stroke fills said outer chamber to compress said element and over it said inner chamber to deliver fluid over said outlet valve while said inlet valves lets fluid into said inner chamber when said piston returns and permits the expansion of said element and of said inner chamber.

20. The arrangement of claim 19, wherein said cylinder and said piston are multiplied by pluralities of cylinders and pistons with said pluralities provided to said outer chamber with at least one of said pistons stroking alternatingly later than another of said pistons.

21. The arrangemnt of claim 19, wherein a plurality of said outer and inner chambers are provided in a pump with each of said outer chambers communicated to at least one of said cylinders, and, wherein said pistons are driven to delivery strokes by a common piston stroke guide means which is arranged in the respective pump.

* * * * *